United States Patent [19]

Freese

[11] 4,118,804

[45] Oct. 10, 1978

[54] SUSPENDER ENDS

[75] Inventor: Courtland F. H. Freese, Pittsfield, N.H.

[73] Assignee: Globe Manufacturing Company, Pittsfield, N.H.

[21] Appl. No.: 796,892

[22] Filed: May 16, 1977

[51] Int. Cl.[2] ..... A41F 3/02

[52] U.S. Cl. ..... 2/340; 24/DIG. 16; 24/208 R

[58] Field of Search ..... 2/336, 340, 326, 323, 2/304, 305; 128/450, 534; 24/73 CS, 87 GS, DIG. 16, 265 WS, 285 R, 73 A, 208 R

[56] References Cited

U.S. PATENT DOCUMENTS 2,111,664 3/1938 Gross ..... 24/DIG. 16

FOREIGN PATENT DOCUMENTS 521,935 6/1940 United Kingdom ..... 2/340

*Primary Examiner*—Doris L. Troutman

*Attorney, Agent, or Firm*—Watson, Cole, Grindle & Watson

[57] ABSTRACT

A suspender end adapted for use in a suspender set is disclosed. The suspender end comprises an elongated strip of flexible material having a middle portion and two end portions, each end portion of the strip including a fastening means, and a releasable fastening means of two parts affixed to the middle portion of the strip, the two parts of the releasable fastening means being laterally spaced from one another such that when the strip is folded on a bias over on itself, the two parts of the fastening means are able to engage each other and securely lock.

6 Claims, 2 Drawing Figures

SUSPENDER ENDS

BACKGROUND OF THE INVENTION

The present invention relates to suspender ends adapted for use in a suspender set and is more particularly concerned with a suspender end formed of an elongated strip of flexible material having a releasable fastening means of two parts on the middle portion of the strip located such that when the elongated strip is folded on a bias over on itself, the two parts of the fastening means are able to engage and securely lock.

Suspenders have been in use for a great number of years, primarily as an article of apparel worn for the purpose of maintaining trousers and the like in their proper position on the wearer's body. In more recent years, a primary use of suspenders has been in conjunction with work clothing, particularly with protective clothing used by firemen and the like such as fire suits, which are generally too bulky and heavy to be comfortably maintained and supported in the proper position on the wearer by a belt or other conventional support means.

A set of suspenders, sometimes referred to as a pair of suspenders, typically comprises two flexible strips of leather, webbing or other suitable material which, when worn and attached to a garment such as a pair of trousers, extend from the front of the waistband of the trousers up the chest of the wearer, over the shoulders where the strips cross and then attach to the waistband at the back of the trousers. It is conventional practice to join the two strips at the point at which they cross by stitching, rivets, and the like. At each end of each strip, there is usually found what is generally termed a suspender end. The function of the suspender end is to provide a means for releasable attachment of each end of the suspender strip to the garment to be supported by the suspender set. The suspender end is typically fixedly attached to the end of the strip of the suspender set and is designed to be releasably engagable with the garment by buttons, clasps, and the like carried either on the suspender end, the garment or both.

Various types of suspender ends are known in the art. For example, U.S. Pat. No. 180,942 to Sharp discloses a suspender end comprising an elongated strap having button holes at both ends and a longitudinal elongated slot at or near the middle of the strap which is adapted to engage a buckle connection attached to a suspender strip, the slot passing over a tongue provided on the buckle connection. In U.S. Pat. No. 457,448 to Clawson, a suspender end is shown which comprises two elongated straps of leather, webbing or other suitable material, each end of which provided with a button hole for attachment to a garment, the straps adapted to be folded in half about a ring attached to a strip of the suspender set such that each end of the strap coincides. A rivet passes through each folded strap thereby securing the strap to the ring and a slot is provided in a portion of each strap so that the strap may slide relative to the rivet.

In U.S. Pat. No. 726,865 to Clarke, a suspender end is disclosed which consists of an elongated strap having a button at each end. The strap as taught by Clarke is adapted to be folded on the bias at a point where the strap engages a keeper attached to a strip of a suspender set. In U.S. Pat. No. 849,801 to MacWilliam, a suspender end is shown comprising an elongated strap having button holes at each end, the strap adaped to be folded on the bias over a keeper on the suspender set, the suspender end being maintained in that position by a staple passing through both portions of the folded-over strip. In U.S. Pat. No. 2,185,400 to Cohen, a suspender end formed of a strap of non-elastic webbing folded centrally with two diagonally extending fold which form crossing tabs below the fold line, the strap being held in its folded form by a male snap fastener member adapted to snap into a socket fastener member carried by a strip of the suspender set.

As was stated previously, an important application for suspenders presently is in supporting heavy and bulky work clothing such as fireman's trousers. In such applications, there is considerable wear and stress on the portions of the suspender end which engage the garment. As frequently happens, the suspender end tears or breaks thereby rendering the end unsuitable for further use. It is therefore desirable to provide a suspender end which can be easily replaced rather than replacing the entire suspender set, yet provide sufficient strength for the support of heavy garments.

SUMMARY OF THE INVENTION

Accordingly, it is an object of the present invention to provide a suspender end which is easily releasable from a suspender set. It is another object of the present invention to provide a suspender end which, by its construction, is sufficiently strong enough to support heavy garments. Yet another object of the present invention is to provide a suspender end which is for use with a variety of types of suspender sets. Another object of the present invention is to provide a suspender end which allows balanced weight distribution when used as a portion of a suspender set supporting a garment. A further object of the present invention is to provide a suspender end which can be easily and inexpensively made in a production type operation.

Briefly, the invention in its broadest aspects comprises a suspender end adapted for use in a suspender set comprising an elongated strip of flexible material having a middle portion and two end portions, each end portion of the strip including a fastening means, and a releasable fastening means of two parts affixed to the middle portion of the strip, the two parts of the fastening means being laterally spaced from one another such that when the strip is folded on a bias over on itself, the two parts of the fastening means are able to engage and securely lock.

Further objects, advantages, and features of the present invention will become more fully apparent from a detailed consideration of the arrangement and construction of the constituent parts as set forth in the following description taken together with the accompanying drawing.

DETAILED DESCRIPTION OF THE PREFERRED EMBODIMENTS

Figure 1:
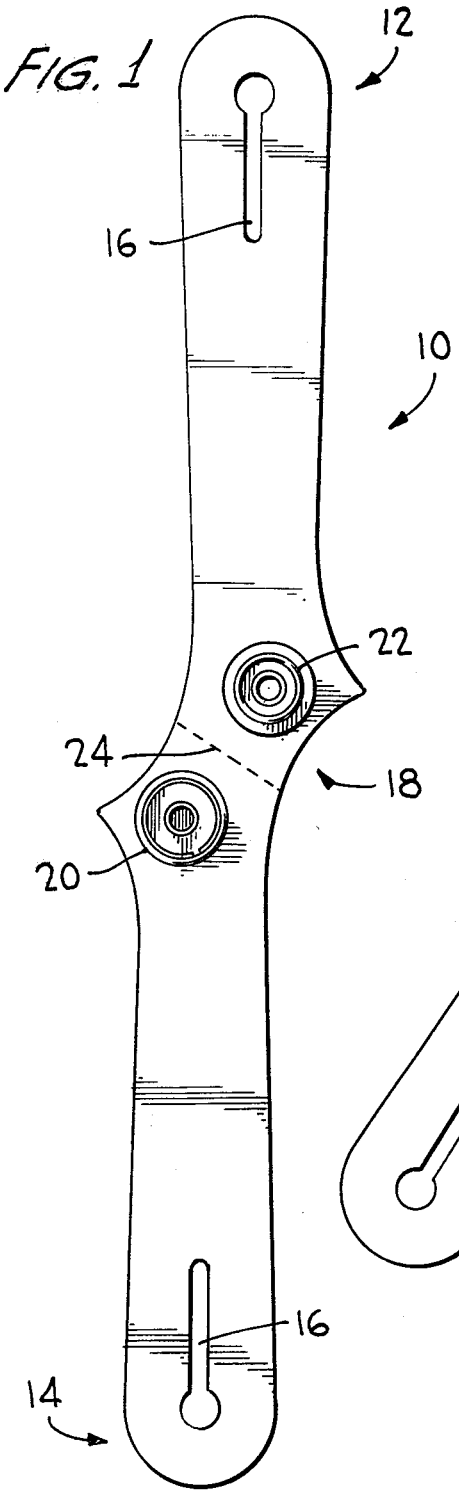
FIG. 1 is a top view of a suspender end in accordnce with the present invention.

Referring now to FIG. 1, there is shown a suspender end which comprises an elongated strip 10 of a suitable material such as leather. At the end portions 12 and 14 of strip 10 are fastening means 16 which, in this embodiment, consist of a slot-like aperture having an enlarged portion and are adapted to engage, for example, buttons located on the garment to be supported by the suspender end. Located in the middle portion 18 of the elongated strip 10 is a releasable fastening means of the snap fastener type. The releasable fastening means shown consists of male snap fastener member 20 and socket snap fastener member 22. Snap members 20 and 22 are located on elongated strip 10 such that when the strip is folded along line 24, the snap members are able to engage and thereby securely lock.

The elongated strip 10 may be made of any suitable flexible material such as leather, plastic, cloth, or the like. A presently preferred material for the elongated strip 10 is leather coated with a vinyl type resin material. By the use of such material, the suspender end 10 has good strength and durability, is waterproof, and presents a pleasing appearance.

While the elongated strip 10 as shown in FIG. 1 is not of a regular shape, it should be understood that the strip itself may take a variety of configurations. For example, the strip may be of an elongated rectangular shape, the only requirement being that the strip be of sufficient width such that the members of the releasable fastening means may be laterally spaced from one another so that the strip can be folded on a bias and the members of the fastening means capable of engaging each other. As another example, the strip may be of an elongated configuration having an enlarged generally circular middle portion. The configuration of the elongated strip as shown in FIG. 1 is the presently preferred configuration for the strip, primarily because of esthetic considerations and because the amount of flexible material needed to form the strip is minimized while still retaining sufficient strength. The configuration shown can be generally described as an elongated strip having the longitudinal axes of the two end portions parallel but offset from each other.

Figure 2:
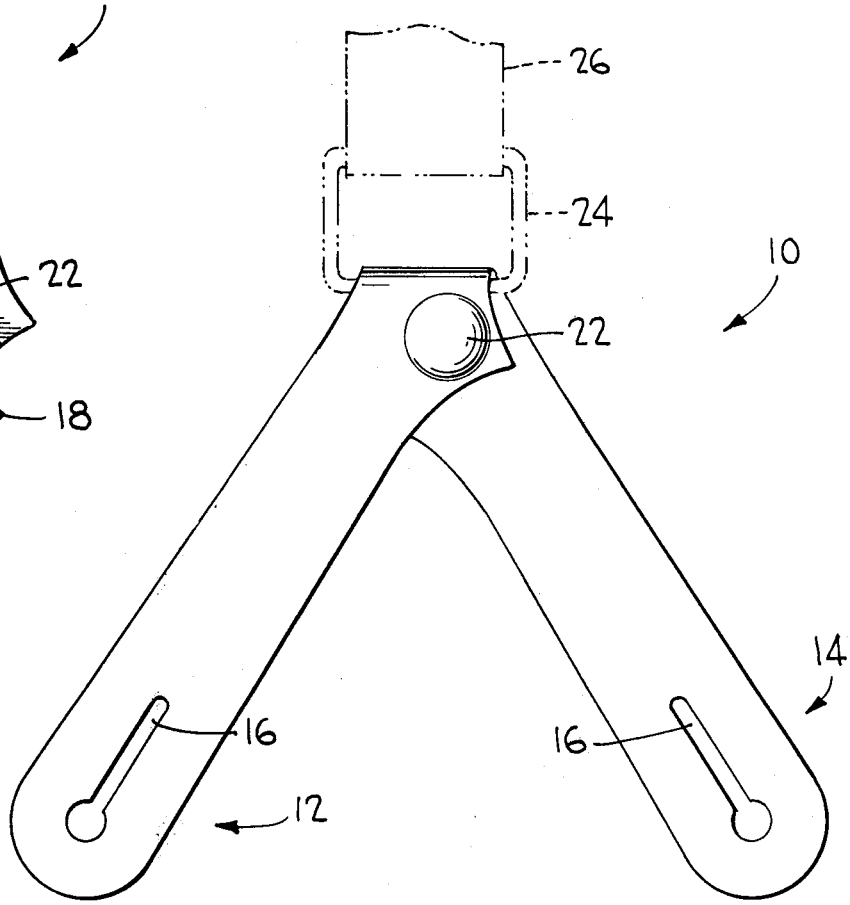
FIG. 2 is another plan view of a suspender end in accordance with the present invention shown in an operative mode and in conjunction with a portion of a suspender set.

FIG. 2 illustrates the suspender end of FIG. 1 when folded along line 24 and in conjunction with a portion of a suspender set. Here the suspender end has been folded about connecting member 28 which is attached to an elastic web 26 forming a part of the suspender set. After folding about the member 28, the members 20 and 22 of the releasable fastening means are securely engaged in a locked arrangement so as to help prevent separation of the end 10 and member 28.

In the use of the suspender end 10 of the present invention, if the suspender end becomes worn or damaged, particularly the fastening means 16, the suspender end may be easily replaced by simply releasing the releasable fastening means and replacing the suspender end with another. Thus, the entire suspender set need not be replaced. In addition, because the releasable fastening means supports little, if any, of the weight of the garment supported by the suspender set, the chances for an accidental release of the releasable fastening means are minimal and therefore the suspender end is not likely to be lost. The suspender end also allows for a balanced weight distribution when used as a portion of a suspender set supporting a garment, which is particularly beneficial when the garment is of considerable weight such as protective clothing.

While the present invention has been described with reference to a particular embodiment thereof, it will be understood that numerous modifications may be made by those skilled in the art without actually departing from the spirit and scope of the invention as defined in the appended claims.

I claim:

1. A suspender end adapted for use in a suspender set comprising an elongated strip of flexible material having a middle portion and two end portions, each end portion of the strip including a fastening means, and a releasable fastening means of two members affixed to the middle portion of the strip, the two members of the releasable fastening means being spaced from one another such that when the strip is folded on a bias over on itself, the two members of the releasable fastening means are able to engage each other and securely lock.

2. A suspender end according to claim 1 wherein the releasable fastening means of two members is a snap type fastener comprising a male snap member and a socket snap member.

3. A suspender end according to claim 1 wherein the flexible material of the elongated strip is vinyl coated leather.

4. A suspender end according to claim 1 wherein the fastening means on each end portion of the strip comprises an elongated aperture in the strip.

5. A suspender end according to claim 4 wherein the aperture includes an enlarged portion.

6. A suspender end according to claim 1 wherein the longitudinal axis of the end portions of the strip are offset and parallel.

* * * * *